US007827787B2

(12) United States Patent
Cherney et al.

(10) Patent No.: US 7,827,787 B2
(45) Date of Patent: Nov. 9, 2010

(54) HYDRAULIC SYSTEM

(75) Inventors: Mark J. Cherney, Potosi, WI (US); Jeffery W. Dobchuk, Dubuque, IA (US)

(73) Assignee: Deere & Company, Moline, IL (US)

( * ) Notice: Subject to any disclaimer, the term of this patent is extended or adjusted under 35 U.S.C. 154(b) by 397 days.

(21) Appl. No.: 11/965,011

(22) Filed: Dec. 27, 2007

(65) Prior Publication Data

US 2009/0165450 A1 Jul. 2, 2009

(51) Int. Cl.
*F15B 11/04* (2006.01)
*F15B 21/00* (2006.01)

(52) U.S. Cl. ..... 60/459; 60/414

(58) Field of Classification Search ..... 60/414, 60/423, 446, 452, 454, 461, 476; 91/361, 91/454, 459

See application file for complete search history.

(56) References Cited

U.S. PATENT DOCUMENTS

| | | | | | |
|---|---|---|---|---|---|
| 3,354,789 | A | | 11/1967 | Schenkelberger | |
| 3,705,631 | A | | 12/1972 | Seaberg | 172/804 |
| 3,851,566 | A | | 12/1974 | Herrmann | 91/411 |
| 4,416,187 | A | * | 11/1983 | Nystrom | 91/454 |
| 4,487,106 | A | | 12/1984 | Field, Jr. | 91/436 |
| 4,836,088 | A | | 6/1989 | Seabaugh | 91/436 |
| 5,195,864 | A | | 3/1993 | Drake et al. | 414/699 |
| 5,287,794 | A | | 2/1994 | Andersson | 91/436 |
| 5,415,076 | A | | 5/1995 | Krone et al. | 91/459 |
| 5,634,334 | A | | 6/1997 | Hehl | 60/328 |
| 5,794,437 | A | * | 8/1998 | Lisniansky | 60/414 |
| 5,845,494 | A | * | 12/1998 | Nishizawa et al. | 60/403 |
| 6,047,228 | A | | 4/2000 | Stone et al. | 701/50 |
| 6,131,391 | A | * | 10/2000 | Poorman | 91/454 |
| 6,161,467 | A | | 12/2000 | A'Hearn et al. | 91/436 |
| 6,405,633 | B1 | | 6/2002 | Dueckinghaus et al. | 91/436 |
| 6,431,050 | B1 | | 8/2002 | Hausman et al. | 91/526 |
| 6,457,487 | B1 | | 10/2002 | Stephenson et al. | 137/596.16 |
| 6,467,264 | B1 | | 10/2002 | Stephenson et al. | 60/460 |
| 6,502,393 | B1 | | 1/2003 | Stephenson et al. | 60/414 |
| 6,622,611 | B2 | | 9/2003 | Nesi | 91/536 |
| 6,626,082 | B2 | * | 9/2003 | Morita et al. | 91/465 |
| 6,640,163 | B1 | | 10/2003 | Pfaff et al. | 700/282 |
| 6,652,239 | B2 | * | 11/2003 | Carstensen | 60/414 |
| 6,715,402 | B2 | | 4/2004 | Pfaff et al. | 91/526 |
| 6,718,759 | B1 | | 4/2004 | Tabor | 60/368 |
| 6,761,029 | B2 | * | 7/2004 | Linerode | 60/459 |
| 6,763,661 | B2 | | 7/2004 | Tabor et al. | 60/327 |
| 6,880,322 | B1 | | 4/2005 | Hirsch | 57/400 |

(Continued)

*Primary Examiner*—Thomas E Lazo
(74) *Attorney, Agent, or Firm*—Taylor IP, P.C.

(57) ABSTRACT

A ground engaging vehicle including a movable member, a hydraulically driven actuator, a hydraulic pump, a plurality of valves and at least one hydraulic conduit. The hydraulically driven actuator is coupled to the movable member and the actuator has a first chamber and a second chamber. The plurality of non-proportional valves include a first valve, a second valve, a third valve and a fourth valve. The at least one hydraulic conduit couples the pump with the first valve and the second valve. The first valve is in direct fluid communication with the first chamber. The second valve is in direct fluid communication with the second chamber. The third valve is in direct fluid communication with the first chamber and the fourth valve is in direct fluid communication with the second chamber. The first valve and the second valve each include an open position and a closed position.

17 Claims, 6 Drawing Sheets

U.S. PATENT DOCUMENTS

| | | | | |
|---|---|---|---|---|
| 6,951,102 | B2 | 10/2005 | Tabor | 60/368 |
| 6,962,050 | B2 * | 11/2005 | Hiraki et al. | 60/414 |
| 6,976,357 | B1 | 12/2005 | Pfaff | 60/422 |
| 6,978,612 | B2 | 12/2005 | Smith et al. | 60/525 |
| 7,089,734 | B2 | 8/2006 | Cook et al. | 60/469 |
| 7,100,371 | B2 | 9/2006 | Bitter et al. | 60/418 |
| 7,104,181 | B2 | 9/2006 | Bitter et al. | 91/437 |
| 7,127,888 | B2 | 10/2006 | Kajita et al. | 60/468 |
| 7,204,084 | B2 | 4/2007 | Ma et al. | 60/422 |
| 7,204,185 | B2 | 4/2007 | Ma et al. | 91/446 |
| 7,210,396 | B2 | 5/2007 | Kuehn et al. | 91/454 |
| 7,233,853 | B2 | 6/2007 | Hendron et al. | 701/50 |
| 2003/0159577 | A1 | 8/2003 | Pfaff et al. | 91/525 |
| 2004/0221714 | A1 | 11/2004 | Bitter et al. | 91/436 |
| 2005/0044849 | A1 | 3/2005 | Berthod et al. | 60/468 |
| 2005/0211312 | A1 | 9/2005 | Pfaff et al. | 137/596.17 |
| 2005/0211936 | A1 | 9/2005 | Tabor et al. | 251/129.04 |
| 2005/0246082 | A1 | 11/2005 | Miki et al. | 701/50 |
| 2006/0089773 | A1 | 4/2006 | Hendron | 701/50 |
| 2006/0108185 | A1 | 5/2006 | Bitter | 188/151 |
| 2006/0131040 | A1 | 6/2006 | Barber | 172/200 |
| 2006/0201146 | A1 | 10/2006 | Tabor | 60/413 |
| 2007/0130927 | A1 | 6/2007 | Pfaff | 60/327 |
| 2007/0209503 | A1 | 9/2007 | Pfaff et al. | 91/433 |
| 2007/0227136 | A1 | 10/2007 | Pfaff | 60/422 |
| 2007/0251129 | A1 | 11/2007 | Cook et al. | 37/195 |
| 2007/0277740 | A1 | 12/2007 | Delman et al. | 37/348 |

* cited by examiner

HYDRAULIC SYSTEM

FIELD OF THE INVENTION

The present invention relates to a hydraulic system, and more particularly, to a ground engaging vehicle utilizing a hydraulic control system.

BACKGROUND OF THE INVENTION

Hydraulics has a history practically as old as civilization itself. Hydraulics, more generally, fluid power, has evolved continuously and been refined countless times into the present day state in which it provides a power and finesse required by the most demanding industrial and mobile applications. Implementations of hydraulic systems are driven by the need for high power density, dynamic performance and maximum flexibility in system architecture. The touch of an operator can control hundreds of horsepower that can be delivered to any location where a pipe can be routed. The positioning tolerances can be held within thousandths of an inch and output force can be continuously varied in real time with a hydraulic system. Hydraulics today is a controlled, flexible muscle that provides power smoothly and precisely to accomplish useful work in millions of unique applications throughout the world.

Most basic systems involve fluid drawn from a reservoir by a pump and forced through a shifted valve into an expandable chamber of a cylinder, which communicates with the work piece, ultimately performing a useful task. After the work is performed, the valve is shifted so the fluid is allowed back to the reservoir. The fluid cycles through this loop again and again. This is a simple on/off operation resulting in only two output force possibilities, zero or maximum. In many industrial and mobile hydraulic applications a dynamic variable force or variable displacement is required. This is accomplished with the use of throttling, a process whereby some of the high-pressure fluid is diverted, depressurized and returned to the reservoir. The use of such a diversion results in an output force at some intermediate point between zero and maximum. If a greater amount of fluid is allowed back to low pressure, the output force is lower. Conversely, if the amount of fluid allowed back to the low pressure portion of the system is less, then the output force is higher. Throttling, while being somewhat inefficient is highly effective.

Another widely implemented form of hydraulics is hydrostatics. A hydrostatic power transmission system consists of a hydraulic pump, a hydraulic motor and an appropriate control. This system can produce a variable speed and torque in either direction. Hydrostatic systems result in an increase in efficiency over the throttling method, but at a high initial expense. An extended control effort is required and response of a hydrostatic system is not as fast as with servo or proportional valves that may be used in a throttling operation.

What is needed in the art is a more efficient hydraulic system for use with mobile equipment.

SUMMARY OF THE INVENTION

The present invention provides a hydraulic system control for use with a ground engaging vehicle.

The invention in one form is directed to a ground engaging vehicle including a movable member, a hydraulically driven actuator, a hydraulic pump, a plurality of valves and at least one hydraulic conduit. The hydraulically driven actuator is coupled to the movable member and the actuator has a first chamber and a second chamber. The plurality of non-proportional valves include a first valve, a second valve, a third valve and a fourth valve. The at least one hydraulic conduit couples the pump with the first valve and the second valve. The first valve is in direct fluid communication with the first chamber. The second valve is in direct fluid communication with the second chamber. The third valve is in direct fluid communication with the first chamber and the fourth valve is in direct fluid communication with the second chamber. The first valve and the second valve each include an open position and a closed position.

DETAILED DESCRIPTION OF THE INVENTION

Figure 1:
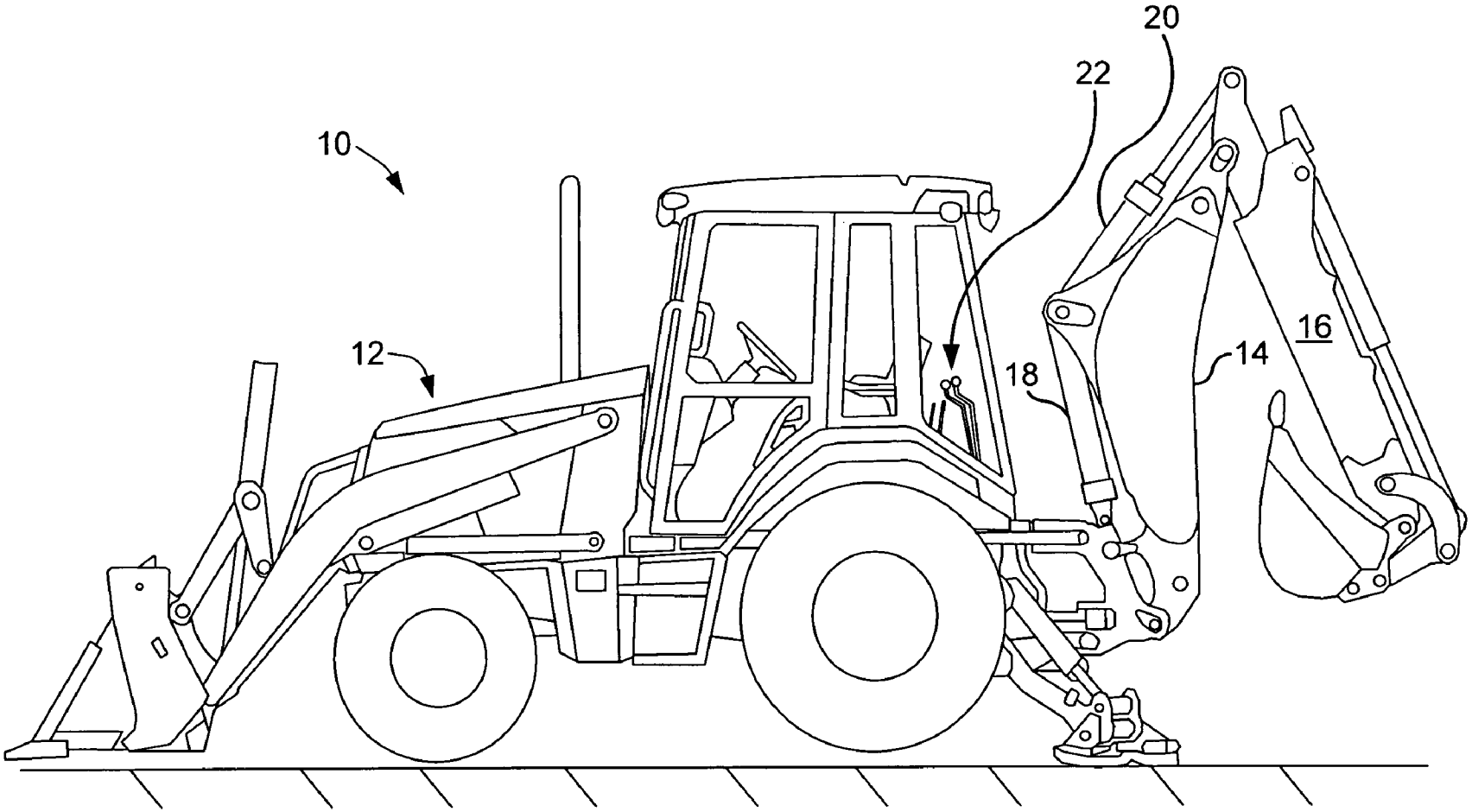
FIG. 1 illustrates a ground engaging vehicle in the form of a loader/backhoe utilizing an embodiment of the hydraulic control system of the present invention.

Referring now to the drawings, and more particularly to FIG. 1, there is shown a ground engaging vehicle 10, more particularly illustrated as a backhoe/loader 10 having an engine 12, a movable arm 14, a moveable arm 16, a hydraulic cylinder 18, a hydraulic cylinder 20 and control levers 22. Vehicle 10 includes a hydraulic system control that is more precisely described in the following discussion that is driven by engine 12. The hydraulic system providing power to move movable arms 14 and 16 by way power provided to hydraulic cylinders 18 and 20 and under the control of an operator by way of control levers 22.

Figure 2:
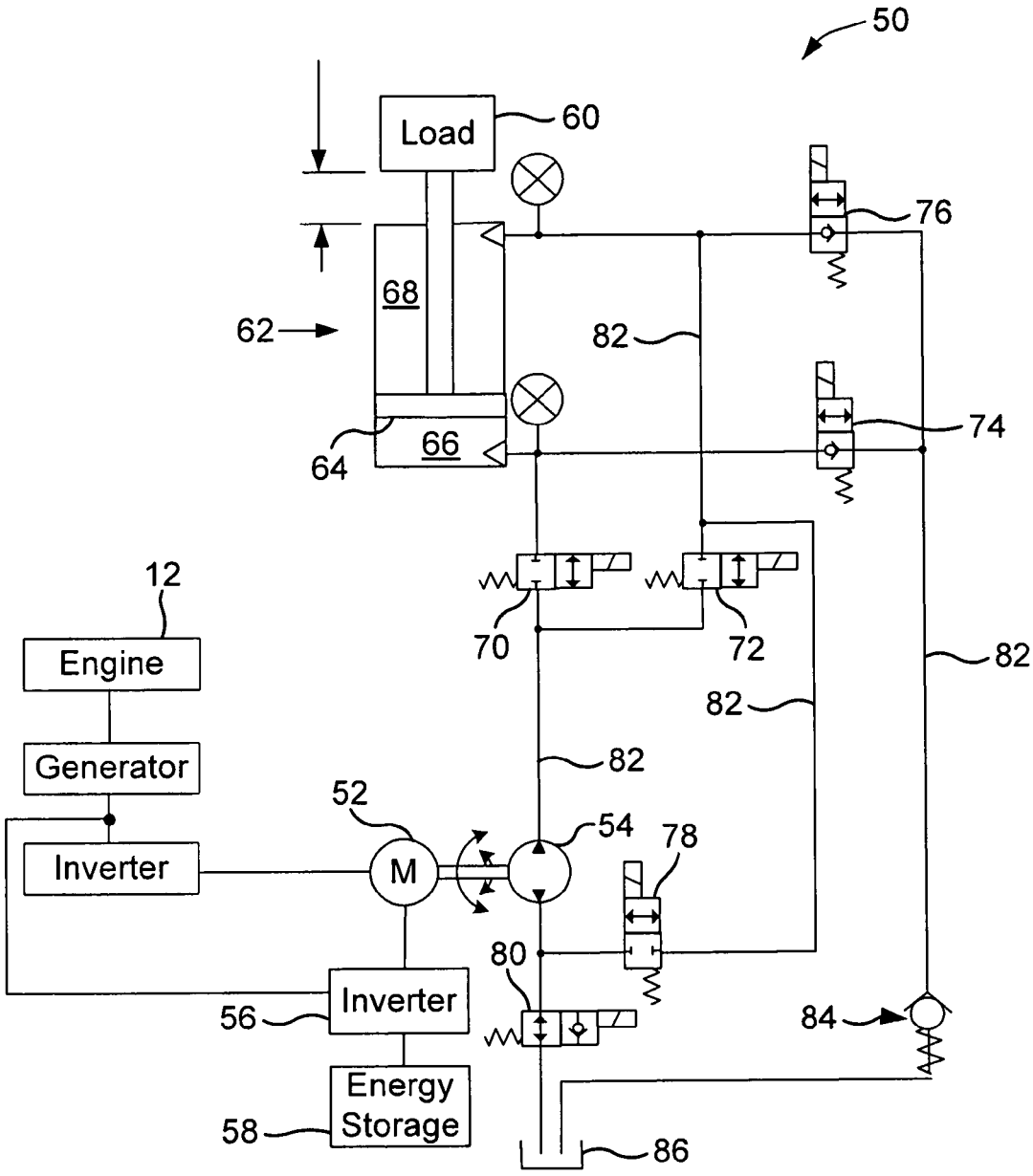
FIG. 2 is a schematical representation of one embodiment of the hydraulic control system used by the loader/backhoe of FIG. 1.

Referring additionally now to FIG. 2, there is shown a schematic illustration of system 50 that includes an electrical hydraulic control of a typical hydraulic actuator such as a hydraulic cylinder 18 or 20. For ease of illustration, the hydraulic cylinder utilized in the schematics generically refer to any hydraulic cylinder utilized on vehicle 10, not just to cylinders 18 and 20, which simply exemplify motive power for moving arms 14 and 16 respectively. Electro-hydraulic system 50 includes an electric motor 52, a pump/motor 54, an inverter/charger 56, a storage element 58, which provide power to system 50 to ultimately drive load 60 by way of actuator 62. Actuator 62 may be thought of as a generic hydraulic cylinder and it includes a piston 64 having a chamber 66 on one side of piston 64 and a chamber 68 on the other side of piston 64. Electro-hydraulic system 50 further includes valves 70, 72, 74, 76, 78 and 80 that are interconnected within system 50 by way of hydraulic lines 82. System 50 further includes check valve 84 and a reservoir 86.

Electric motor 52 is electrically controlled to supply a specific amount of rotating velocity to the shaft that interconnects motor 52 with pump/motor 54. A control 22 is moved, thereby instructing the controller to send a signal to cause inverter 56 to supply power to electric motor 52. The speed of electric motor 52 is effectively regulated by a control 22 causing a production of hydraulic flow of fluid from reservoir 86 through valve 80 depending upon the selection of the position of valves 70-80. System 50 operates by utilizing digital on/off valves 70-80 and these valves are not proportional valves as are utilized in prior art systems. Proportional valves, or throttling valves restrict or meter the fluid flow therethrough and are not used in the present invention, where the metering of the fluid flow is accomplished by the controlled driving of pump 54.

The combination of motor 52 and pump 54 provide the metering of flow of the hydraulic fluid by controlling the speed of pump/motor 54 to correspond to the desired action as selected by the operator's movement of a control lever 22. If it is desired to move load 60 upward by providing pressurized fluid to chamber 66 then valves 70 and 78 may be energized to thereby allow hydraulic fluid to be pumped from chamber 68 into chamber 66 thereby moving load 60 in the desired direction. Additionally, valve 80 may be energized thereby placing a check valve in the flow of fluid from reservoir 86 to pump 54 thereby allowing only any needed makeup of fluid to be drawn into the system. Additionally, valves 74 and 76 may be positioned to prevent cavitation of the system during its operation. Once load 60 is in a desired position as indicated by a return of a control 22 to a neutral position, then valves 70 and 78 may be returned to their normally closed position to prevent hydraulic fluid flow through lines 82 thereby holding load 60 and its desired position. For purposes of illustration, load 60 will be assumed to having been moved to a higher energy potential, which can be understood in light of FIG. 1 as the raising of load 60 along with the weight of a movable member, for example, moving moveable arm 16 into a higher position relative to the ground. When it is desirable to lower load 60, this can be accomplished in different manners including one in which energy is recovered from the lowering of the potential energy of load 60, which is undertaken by allowing pump/motor 54 to reverse drive electric motor 53 causing electric motor 52 to function as a generator or alternator 52 causing the circuitry of inverter/charger 56 to charge energy storage 58, which may be an electrical energy storage device 58 in the form of a battery 58, thereby converting energy from the loss of potential mechanical positioning of load 60. This is accomplished by energizing valve 70 and 78 while electrically not energizing motor 52 to thereby allow the hydraulic pressure coming from chamber 66 to pass through valve 70 through pump/motor 54 driving the shaft that is connected to motor 52 to allow the recovery of energy. Alternatively, if the speed of load 60 is inadequate then valve selections can be undertaken to cause load 60 to be driven down by energizing electric motor 52 in an opposite direction driving pump 54 in the opposite direction as well. In another alternate configuration, if pump 54 is driven in the same direction then valve 72 can be activated thereby supplying pressure to chamber 68 then valve 74 is energized allowing the flow to go through check valve 84 back to the reservoir.

By electronically controlling and reversing motor 52 this allows for the driving of pump 54, which is a fixed displacement pump causing the movement of piston 64 thus load 60. This advantageously eliminates the proportional control valve that meters the flow and eliminates pressure losses through such valves. In this embodiment, each hydraulic cylinder of vehicle 10 has its own pump to thereby minimize the losses due to valve metering. Furthermore, pump 54 is turned into motor 54 to capture energy from over-running loads such as if load 60 is the lowering of moveable arm 16 or lowering of any other portion wherein potential energy can be recovered. The retraction speed can be faster as the pump can spin faster when in the motor mode and since the retraction is almost always due to gravity and its affect on the movement of load 60 and the rod side makeup fluid can be done by appropriate activation of valves 74 and/or 76. Additionally, powering down the load can be further supplemented by appropriate positioning of valves 74, 78 and/or 80 without reversing direction of the motor. If the reservoir is pressurized it may enable faster pump rotation more flow or reduced displacement. If the reservoir is pressurized potentially the return check valve can be eliminated.

Figure 3:
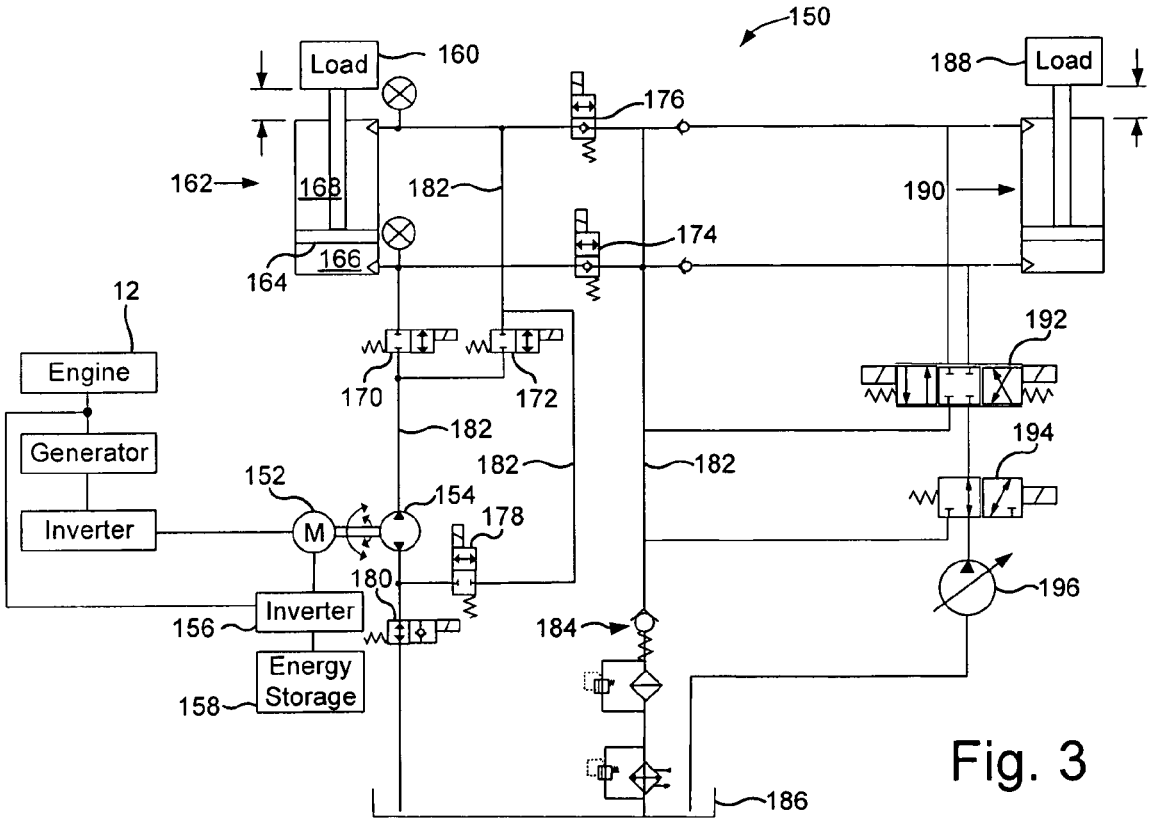
FIG. 3 is a schematical representation of another embodiment of a hydraulic control system used in the loader/backhoe of FIG. 1.

Now, additionally referring to FIG. 3 there is illustrated another embodiment of the present invention identified as hydraulic system 150 where elements are numbered similar to that in FIG. 2 except that they are all increased by the number 100. Additionally illustrated in FIG. 3 are the movement of a load 188 by an actuator 190 schematically similar to actuator 162, additional valves 192 and 194 along with a Load Sense (LS) pump 196. In this embodiment an additional actuator 190 is driven from a common reservoir with the elements shown in FIG. 2. The two hydraulic circuits benefit each other by utilizing a common tank rail to drive the anti-cavitation flow and to minimize pump flow during a gravity extend or retract. Valve 194 is used to block pump flow in the case of a gravity induced load while valve 192 is used to control the speed of actuator 190. The functioning of valve 192 and 194 could be combined into one valve. Pressurized fluid from actuator 162 may be routed to actuator 190 when both are commanded to move and the fluid contained in a chamber of actuator 162 is of sufficient pressure to move actuator 190. This may occur, for example, when load 160 is being lowered.

Figure 4:
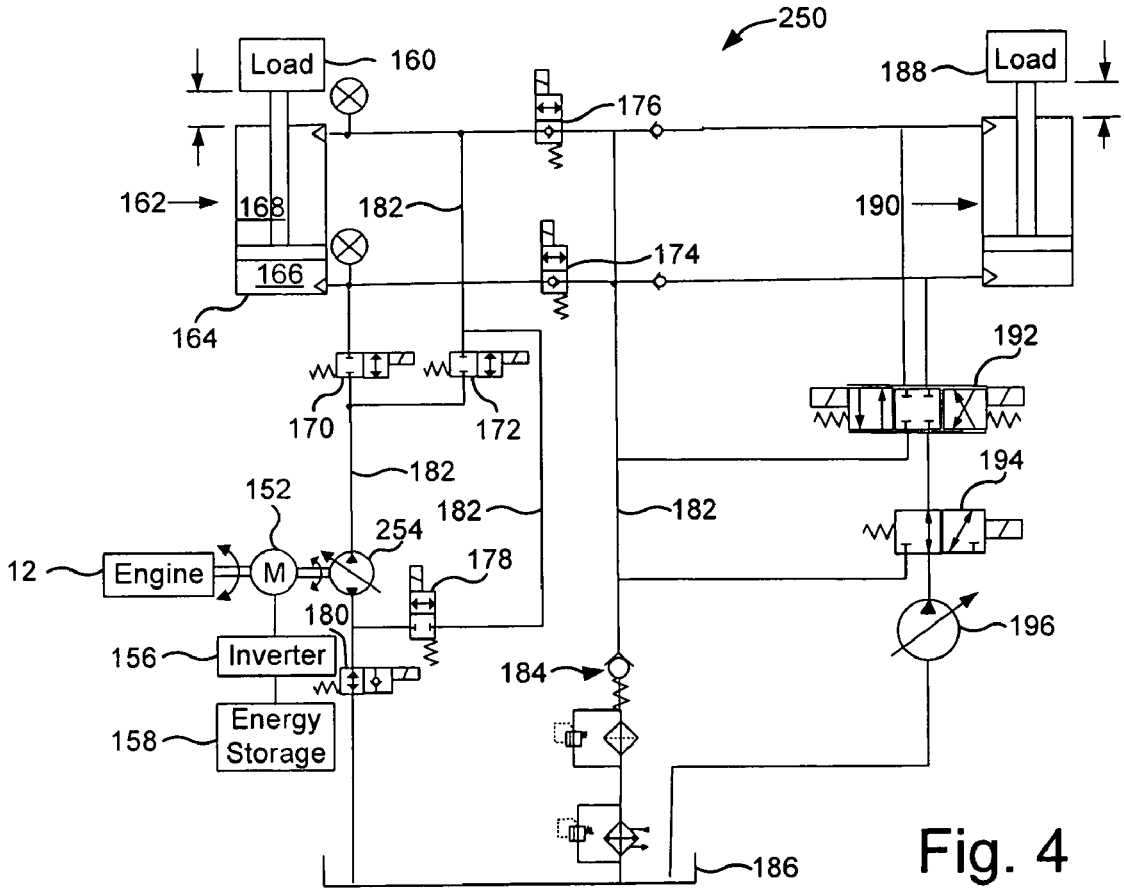
FIG. 4 is a schematical representation of yet another embodiment of a hydraulic control system used in the loader/backhoe of FIG. 1.

Now, additionally referring to FIG. 4, there is illustrated another embodiment of the present invention identified as hydraulic system 250, that is substantially similar to that in FIG. 3 except that motor 152 is directly linked to engine 12. Motor 152 functions as a generator and also directly drives a pump 254 that includes a bidirectional swash plate like a hydrostatic pump. Here again a pressurized reservoir 186 can prove advantageous. Engine 12 directly drives pump 254, with motor 152 functioning as a generator/motor to either provide additional power to pump 254 or to store energy in energy storage device 158 when pump 254 does not require as much energy as is available from engine 12. This system approach allows a much smaller generator/motor and power electronics than those illustrated in FIGS. 2 and 3.

Figure 5:
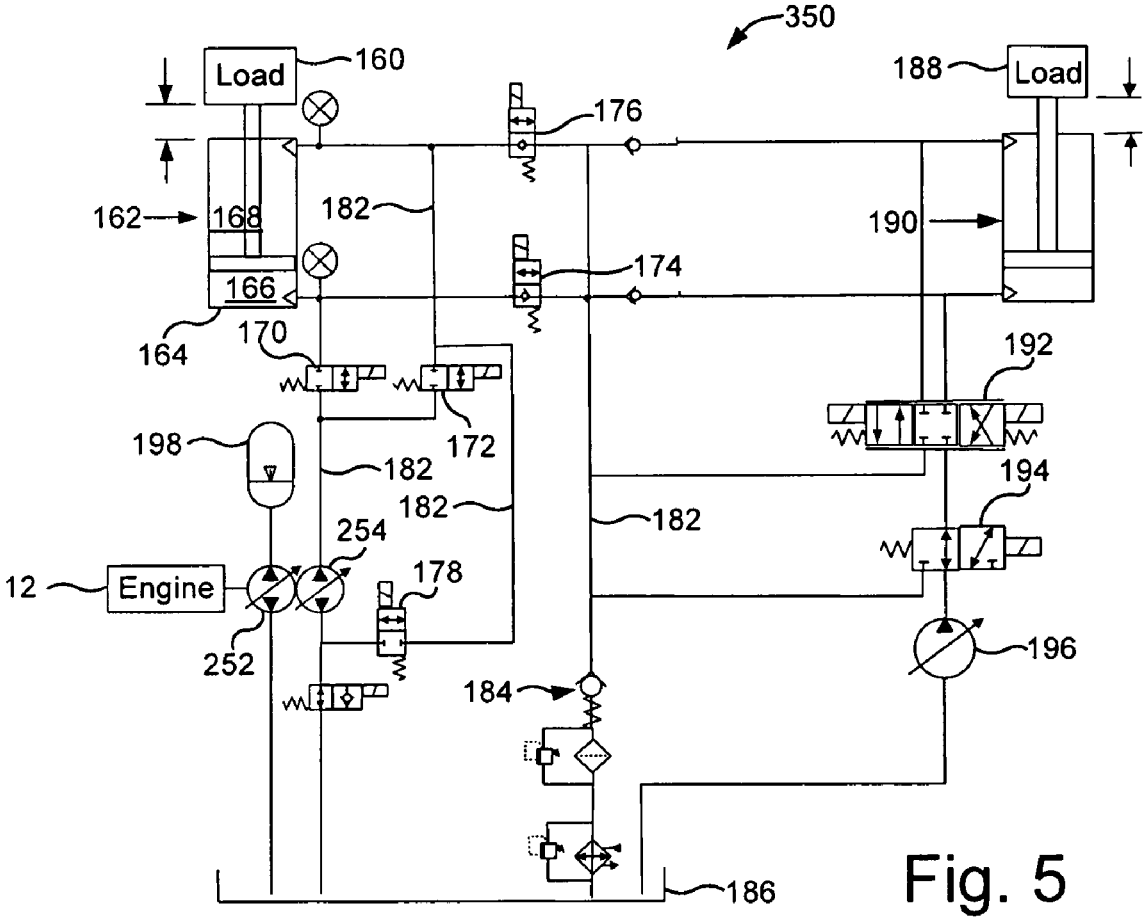
FIG. 5 is a schematical representation of still another embodiment of a hydraulic control system used in the loader/backhoe of FIG. 1.

Now, additionally referring to FIG. 5, there is shown a system 350 that is substantially similar to FIGS. 3 and 4 except that motor 152 along with inverter 156 and energy storage 158 have been eliminated and a hydraulic accumulator 198 is added along with a hydraulic pump 252. In this case, pump 254 is directly driven by engine 12 with hydraulic pump 252 providing supplemental power when needed by drawing on energy stored in accumulator 198. The function is similar to that described above being undertaken this time with a hydraulic driving fluid rather than the electrical supplement of power. Pump 252 may be a proportional pump that is electrohydraulically controlled and is used to store energy in hydraulic accumulator 198 similar to the storage of energy in batteries 58 or 158. Again as energy is removed from either loads 60, 160 or 188 the fluid may be routed so as to drive hydraulic motor 254. Motor 254 may be variably coupled through a transmission system (not shown), and may be under the control of a controller, causing the driving of pump/motor 252 to store energy in hydraulic accumulator 198. This configuration is similar to that described previously where energy is stored and removed from hydraulic accumulator 198 as a storage system. Further, pump 254 may have a fluid flow therethrough that is variable by the varying of the speed of the pump and/or the displacement of the pump.

The overall advantage of the present invention is that the flow provided by the pump system is substantially unmetered or restricted except for any natural restriction which may occur in hydraulic lines 82 or 182 so that energy is not lost in the metering process as it is in the prior art control systems utilized on ground engaging vehicles. The present invention provides for the improvement of energy capture of a hydraulic system which may be by way of a dual hydrostatic pump and accumulator system while simplifying the system design. The embodiments presented allow for a reduction in fuel consumption by tying in the second cylinder into the energy saving technique of the present apparatus and method. Further, the embodiments presented above may feed back energy to the drive train for immediate use rather than storing it in the energy storage device. This is considered energy re-use so that the potential energy stored in an elevated load is directly used as the load is lowered. For example, if an operator is simultaneously lowering a loader bucket and accelerating the tractor, the energy derived from the lowering of the loader bucket is used add energy to the drive train thereby reducing a load on the engine.

Figure 6:
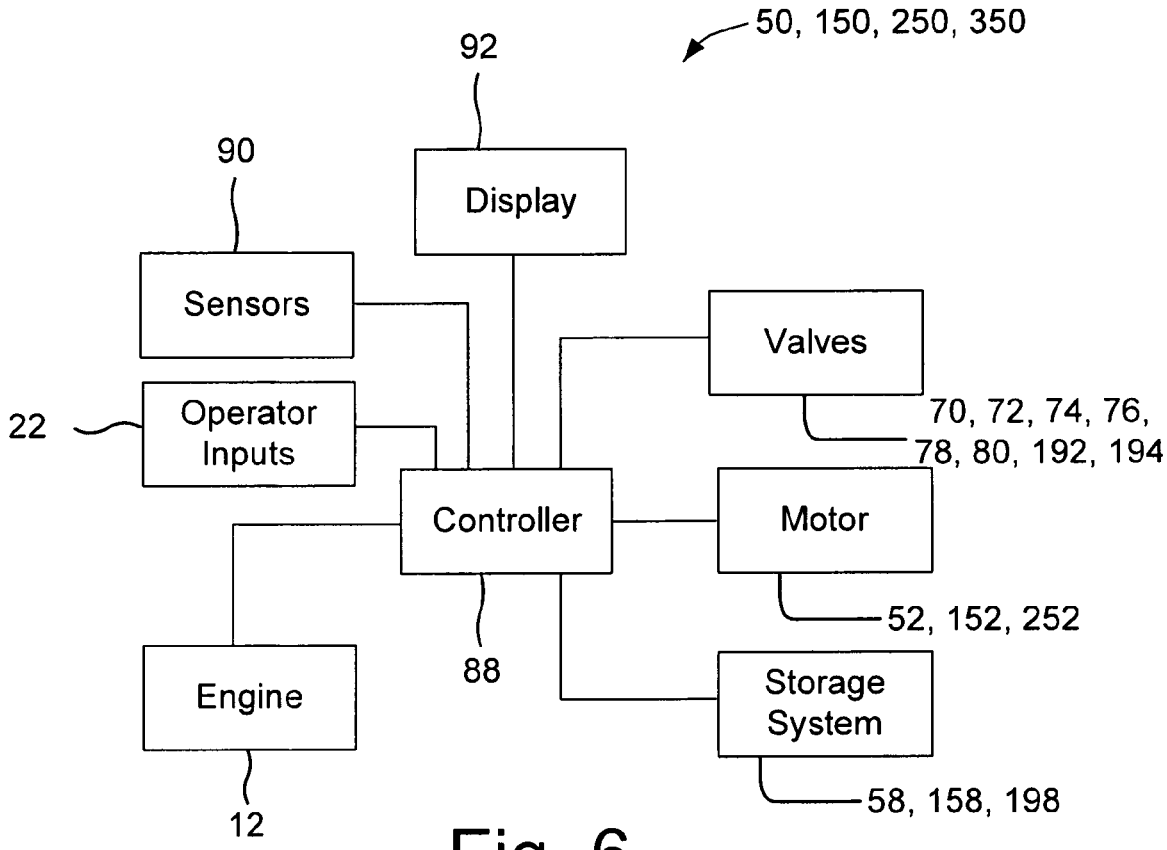
FIG. 6 is a schematic block diagram illustrating a connection of a controller which uses a method of the present invention to thereby show the controlling interconnections of the various components with systems utilize the vehicle of FIG. 1 and the embodiments of FIGS. 2-5.

Now, additionally referring to FIG. 6 there is a schematic block diagram of system 50, 150, 250 or 350 including controller 88, sensors 90 and a display 92. The interconnection of these elements is illustrated to show the controlling interaction between a controller 88 and engine 12, operator inputs 22, sensors 90, display 92, valves 70 et al., motor 52, 152, 252 and storage system 58, 158 and 198. Controller 88 reacts to operator inputs 22 as well as information from sensors 90 to control the fluid flow in the system. Sensors 90 may include pressure sensors and positional sensors both linear and angular in nature to supply feedback signals to controller 88 of the movement of the actuators and the load that is being moved by the system. Valves 70 et al. are not metering valves but are rather digitally operated valves providing either complete fluid flow, no fluid flow or the introduction of a check valve into the line. No metering is undertaken by valves 70 et al.

Having described the preferred embodiment, it will become apparent that various modifications can be made without departing from the scope of the invention as defined in the accompanying claims.

The invention claim is:

1. A ground engaging vehicle, comprising:

a movable member;

a hydraulically driven actuator coupled to said movable member, said actuator including a first chamber and a second chamber;

a hydraulic pump;

a plurality of non-proportional valves including a first valve, a second valve, a third valve and a fourth valve;

at least one hydraulic conduit coupling said pump with said first valve and said second valve, said first valve being in direct fluid communication with said first chamber, said second valve being in direct fluid communication with said second chamber, said third valve being in direct fluid communication with said first chamber, said fourth valve being in direct fluid communication with said second chamber, said first valve and said second valve each including an open position and a closed position;

an energy storage device, said hydraulic pump being driven by said fluid flow to thereby store energy in said energy storage device, said energy storage device includes a hydraulic accumulator; and a reservoir tank, said third valve being fluidly coupled to said first chamber and to said reservoir tank, said fourth valve being fluidly coupled to said second chamber and to said reservoir tank, said plurality of non-proportional valves further includes a fifth valve and a sixth valve, said fifth valve being directly fluidly coupled to said hydraulic pump and to said reservoir tank, said sixth valve being directly fluidly coupled to said second chamber and said hydraulic pump.

2. The ground engaging vehicle of claim 1, wherein said hydraulic pump is driven at a selected speed to provide a metered fluid flow in said at least one hydraulic conduit.

3. The ground engaging vehicle of claim 2, wherein every said valve in said fluid flow is a digital non-proportional valve.

4. The ground engaging vehicle of claim 1, wherein every valve in fluid communication with said pump and said actuator is a digital non-proportional valve.

5. The ground engaging vehicle of claim 1, wherein said energy storage device includes an electrical energy storage device.

6. The ground engaging vehicle of claim 1, wherein said fifth valve includes a check valve position and an open position.

7. A hydraulic system for use on a ground engaging vehicle, the hydraulic system comprising:

a hydraulically driven actuator including a first chamber and a second chamber;

a hydraulic pump;

a plurality of non-proportional valves including a first valve, a second valve, a third valve and a fourth valve;

at least one hydraulic conduit coupling said pump with said first valve and said second valve, said first valve being in direct fluid communication with said first chamber, said second valve being in direct fluid communication with said second chamber, said third valve being in direct fluid communication with said first chamber, said fourth valve being in direct fluid communication with said second chamber, said first valve and said second valve each including an open position and a closed position; and an other hydraulically driven actuator fluidly coupled to said hydraulically driven actuator such that pressurized fluid from one of said first chamber and said second chamber is transferred to said other hydraulically driven actuator.

8. The hydraulic system of claim 7, wherein said hydraulic pump is driven at a selected speed to provide a metered fluid flow in said at least one hydraulic conduit.

9. The hydraulic system of claim 8, wherein every said valve in said fluid flow is a digital non-proportional valve.

10. The hydraulic system of claim 7, wherein every valve in fluid communication with said pump and said actuator is a digital non-proportional valve.

11. The hydraulic system of claim 7, further comprising an energy storage device, said hydraulic pump being driven by said fluid flow to thereby store energy in said energy storage device.

12. The hydraulic system of claim 11, wherein said energy storage device includes a battery.

13. The hydraulic system of claim 11, wherein said energy storage device includes a hydraulic accumulator.

14. The hydraulic system of claim 13, further comprising a reservoir tank, said third valve being fluidly coupled to said first chamber and to said reservoir tank, said fourth valve being fluidly coupled to said second chamber and to said reservoir tank.

15. The hydraulic system of claim 7, wherein said hydraulic pump has a fluid flow therethrough, said hydraulic pump being configured to vary said fluid flow by varying one of a speed of said pump and said displacement of said pump.

16. A hydraulic system for use on a ground engaging vehicle, the hydraulic system comprising:

a hydraulically driven actuator including a first chamber and a second chamber;

a hydraulic pump;

a plurality of non-proportional valves including a first valve, a second valve, a third valve and a fourth valve;

at least one hydraulic conduit coupling said pump with said first valve and said second valve, said first valve being in direct fluid communication with said first chamber, said second valve being in direct fluid communication with said second chamber, said third valve being in direct fluid communication with said first chamber, said fourth valve being in direct fluid communication with said second chamber, said first valve and said second valve each including an open position and a closed position, an energy storage device, said hydraulic pump being driven by said fluid flow to thereby store energy in said energy storage device, said energy storage device includes a hydraulic accumulator; and a reservoir tank, said third valve being fluidly coupled to said first chamber and to said reservoir tank, said fourth valve being fluidly coupled to said second chamber and to said reservoir tank, said plurality of non-proportional valves further includes a fifth valve and a sixth valve, said fifth valve being directly fluidly coupled to said hydraulic pump and to said reservoir tank, said sixth valve being directly fluidly coupled to said second chamber and said hydraulic pump.

17. The hydraulic system of claim 16, wherein said fifth valve includes a check valve position and an open position.

* * * * *